US005457943A

United States Patent [19]

Hertrampf

[11] Patent Number: 5,457,943

[45] Date of Patent: Oct. 17, 1995

[54] METHOD FOR FORMING A SEALING CLOSURE FOR A BOTTLE

[76] Inventor: Michael Hertrampf, Schäfereiweg 7, D-3007 Gehrden 1, Germany

[21] Appl. No.: 197,316

[22] Filed: Feb. 16, 1994

Related U.S. Application Data

[62] Division of Ser. No. 966,027, Dec. 23, 1992, abandoned.

[30] Foreign Application Priority Data

Jul. 12, 1990 [DE] Germany ..... 40 22 196.2

[51] Int. Cl.[6] ..... B67B 3/12; B67B 3/18

[52] U.S. Cl. ..... 53/488; 53/331

[58] Field of Search ..... 53/488, 334, 338, 53/359, 331

[56] References Cited

U.S. PATENT DOCUMENTS

| | | | |
|---|---|---|---|
| 965,498 | 7/1910 | Adriance et al. | 53/488 |
| 2,409,788 | 10/1946 | Osborne | 53/488 |
| 2,409,789 | 10/1946 | Osborne | 53/488 |
| 3,039,247 | 6/1962 | Thomas et al. | 53/488 |
| 3,219,004 | 11/1965 | Wilton | 53/488 X |
| 3,223,268 | 12/1965 | Whitchurch | 53/488 X |
| 3,273,303 | 9/1966 | Hill | 53/488 |
| 3,450,291 | 6/1969 | Lovell | 53/488 X |
| 4,555,208 | 11/1985 | Houdayer et al. | 53/488 X |
| 4,628,669 | 12/1986 | Herron et al. | 53/488 X |

*Primary Examiner*—Horace M. Culver
*Attorney, Agent, or Firm*—Banner & Allegretti, Ltd.

[57] ABSTRACT

A sealing closure for a bottle which relieves excess pressure is formed by placing an aluminum cap including a sealing disk of compressible elastic material on the bottle neck, and forming the cap by means of a die which is pressed axially against the top or frontal surface of the bottle neck. The die has circumferentially-spaced projections which produce corresponding depressions in the cap opposite the frontal surface and simultaneously compress the disk between the cap and the frontal surface leaving the areas between said depressions slightly compressed. Excess gas escapes by compressing the slightly compressed areas of the sealing disk to lift the disk off the lip of the bottle.

2 Claims, 3 Drawing Sheets

METHOD FOR FORMING A SEALING CLOSURE FOR A BOTTLE

This application is a division of Ser. No. 07/966,027 filed Dec. 23 1992 and now abandoned. The invention relates to a method for forming a sealing closure for a bottle or the like which relieves excess internal pressure.

PRIOR ART

A sealing closure is already known, from the German patent number DE-PS 36 42 998, U.S. Pat. No. 4,844,271 in which, in addition to the radial, frontal sealing surface, axial sealing surfaces, into which the seal mass of the sealing extends, are also provided in the area of the edge of the aperture of a bottle. or cap is deep-drawn, and extends around the edge of the aperture of the bottle, in order to thereby form the external, axial sealing surface. The essential feature of this known sealing closure consists of the fact that the sealing part is, in at least one partial area—that is to say, at the point of the transition from the sealing part to the support part—not deep-drawn up to the lateral edge of the aperture of the neck of the bottle, but is, rather, removed out from the said deformation. In this manner, an impeded scaling section is created in the non-deformed portion, which section should produce a low level of compression. In this manner, the escape of excess pressure is favored. The escape of the excess pressure is, in such a type of sealing closure, however, less dependent on the sealing section than it is on the support pressure of the cap. In this known sealing closure, the axial pressure is uniform over the entire edge of the aperture. The desired effect to relieve excess pressure is thus only attained to a very small degree.

DE-PS 37 44 292 discloses a sealing closure which has a cap-shaped support part with a projection or collar, which is directed inwardly in order to provide for engagement with an external bulge of the neck of the bottle. This support part is connected, by means of an elastic element, with a sealing part, which has a ring-shaped sealing surface bearing against the frontal surface of the neck of the bottle. The support part has a catch unit fitting with the edge of the neck of the bottle. Since the sealing part likewise abuts with the edge of the neck of the bottle, the relative positions of the support part and the sealing part are thereby precisely defined. Since the elastic element for the pre-stressing of the sealing part is located between these two units, the degree of the prestressing of the elastic element is precisely defined and determines the pressure at which the sealing part rises and opens to excess pressure.

A screw sealing closure is disclosed in U.S. Pat. No. 4,089,434 in which a seal of foam material, which has different thicknesses in its cross-section in diametrical directions, is positioned between the base of the screw cap and the frontal edge of the neck of the bottle. When the cap is screwed on, therefore, the areas of greater thickness are more highly compressed than the areas of lesser thickness. In the areas of lesser thickness, the sealing force is, therefore, lower, and these areas are intended to serve as an excess pressure valve. The opening pressure depends on the compression of the entire seal and is consequently not independent of the torque imposed in screwing on the cap. If the cap is screwed on with too little torque, the areas of lesser thickness are not brought to tight sealing contact. If the cap is screwed on with a force which is too great, then the contact force is also too great in the area of the lesser thickness, so that the opening pressure is correspondingly also great, which entails the danger of the explosion of the bottle. Another disadvantage of this construction is that the greater portion of the torque is eliminated when the cap is screwed on. The areas of the seal which have the greater thickness are compressed, and their surface is significantly greater than the surface of the areas of lesser thickness, so that the increased rise in the torque can scarcely be determined. This results in additional compression in the area of the points of lesser thickness of the seal, particularly if the cap is screwed on by hand. The screwing on of the cap by hand is, however, the normal case under practical conditions, and this is decisive. The danger of an explosion therefore additionally exists in the normal case.

A pressure release seal similar to the U.S. Pat. No. 4,089,434 discussed above is disclosed in DE-OS 1 432 224, with the difference that the areas of smaller thickness of the seal are only located on two short points on the circumference which are diametrically opposed to one another. The largest portion of the seal has the greater thickness. The disadvantages described above are accentuated.

Cap-shaped sealing closures with excess pressure safety mechanisms are disclosed in U.S. Pat. No. 3,114,467 and in German utility model number 8 122 918 O-1, in which a flat sealing disk is positioned within the base, behind which recesses are positioned at a number of points on the circumference. If such a cap is screwed on to the neck of a bottle, and if pressure arises within the bottle, then the edge of the disk-shaped seal rises up slightly at those points at which the recesses within the base of the cap are located, so that excess pressure can escape. One disadvantage of these known screw sealing closures consists of the fact that, within the area of the recesses in the base of the screw caps, absolutely no contact pressure of the edge of the sealing disk is applied on the frontal edge of the neck of the bottle. The contents of the bottle—such as a beverage bottle, for example—can thus escape, even with the lowest excess pressures within the bottle, which is obviously not desirable. There exists the disadvantage, moreover, that, because of the tolerances or the contaminants on the frontal surface of the edge of the bottle or on the seal caused by manufacturing, a tight contact of the sealing with the frontal surface of the neck of the bottle is impossible, particularly in the case of gas bottles.

THE INVENTION

The object of the invention is to provide a method for forming a sealing closure of the type noted, which is simple in its construction and which, because it is thoroughly independent of the torque in screwing on the cap, opens reliably with a predetermined excess pressure.

The invention is distinguished from the known concepts of shortening the sealing section or pressing the sealing part as a whole, by means of an elastic element, against the aperture of the neck of the bottle. It is the basic concept of the invention, rather, to create a sealing, a limit stop and an elastic element solely through the formation by means of a forming die, a ring-shaped elastic seal, which is highly compressed in some areas and lightly compressed in sections between the highly compressed areas. In all the forms of implementation of the invention, it is possible to provide recesses in the cap on the side of the seal which is turned away from the sealing surface, which permits the seal to be compressed into these recesses to relieve internal pressure.

If a bottle is tightly sealed by means of a sealing closure in accordance with this concept, then it results that, within the circumference areas of limited height between these recesses, the seal is supported with a great support force. In these areas, the seal forms a limit stop which determines the precise position of the sealing part in relation to the frontal surface of a neck of the bottle. Also, this means the force with which the circumference areas of the seal within the cap recesses abut on the frontal surface of the neck of the bottle, is also determined precisely. As the result, the circumference area of the seal abuts against the ring-shaped sealing surface on the frontal surface of the neck of the bottle with a force which is determined by its compressibility. Since the compressibility depends on the material composition and the extent to which it is compressed by the cap, and since these can be selected with precision, the pressure on the different areas of the ring-shaped surface can also be determined precisely. Consequently, the pressure at which the seal rises up from the frontal edge of the neck of the bottle to allow the excess internal pressure to escape is also determined precisely.

The method of the invention method includes the steps of inserting an elastic compressible disk of uniform thickness inside a cap of suitable size to cover the opening in the neck of the bottle. The cap is deformed by a forming die which is forced against the bottle neck to produce alternate depressions and projections around the circumference of the cap opposite the frontal surface of the bottle neck. Where the cap is depressed, the seal is highly compressed against the frontal surface. These areas act as a stop. In the cap projections, the seal is only slightly compressed. These areas serve as vents for excess pressure.

Foam material may be used for the seal which expands up into the cap projections and is compressed by excess gas pressure while the segments of foam under the cap depressions maintain a seal against the frontal surface of the bottle neck.

The material of the support and sealing part can be of any type, such as, for example, either plastic or metal. There may be a screw-type or crown-type sealing closure, or any other sealing closure which is desired.

SPECIFIC DISCLOSURE

Figure 1:
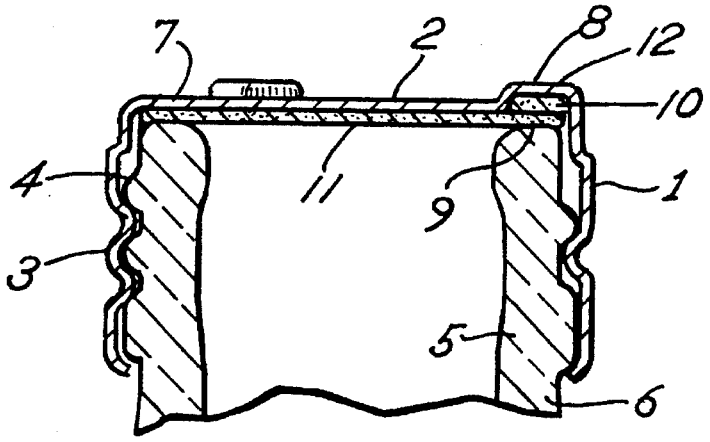
FIG. 1 depicts in a cross-section an example of a closure made by the process of the invention.
Figure 2:
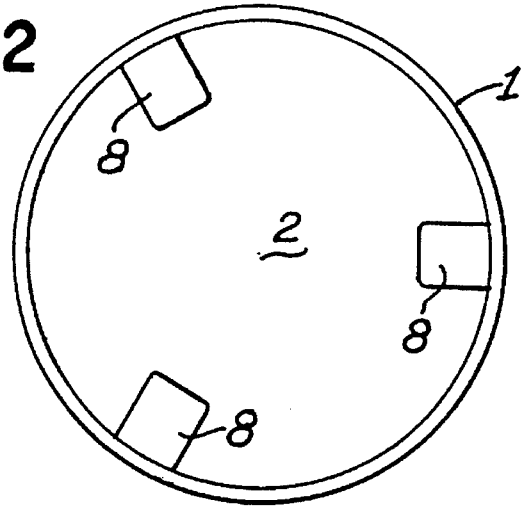
FIG. 2 is a plan view of the closure of FIG. 1.
Figure 3:
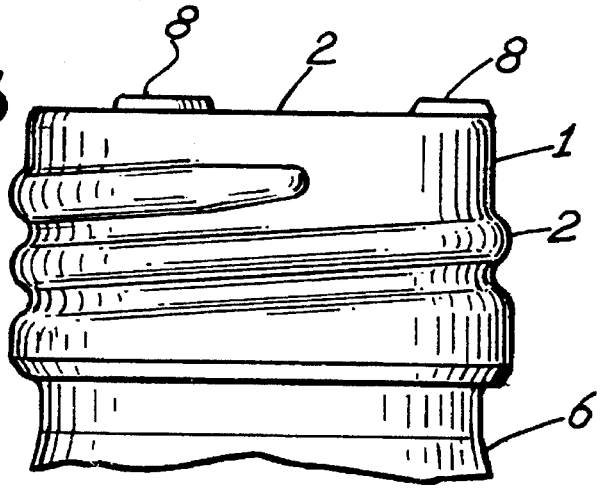
FIG. 3 is a lateral view of the closure of FIG. 1.

In FIGS. 1 to 3, a support part 1 and a sealing part 2 together form a screw cap, having threads 3 which can be screwed onto the bulge-shaped complementary threads 4 of a neck 5 of a bottle 6 only partially shown. The support part 1 and the sealing part 2 are deep-drawn or pressed out of aluminum, as part of the process of the invention.

The sealing part 2 has, in its edge area, a ring-shaped sealing surface 7, which is expanded or raised at three points 8, which points are spaced at a greater distance from the frontal surface or lip 9 of the neck of the bottle 5 than is the ring-shaped sealing surface 7.

Between the ring-shaped sealing surface 7 and its raised areas 8 and the frontal surface 9 of the neck of the bottle 5, there is a seal 10, the sealing surface 11 of which lies in a radial plane, in relation to the neck of the bottle 5, while its sealing surface 12 positioned on the other side is formed in a manner which is complementary to the ring-shaped sealing surface 7 or its raised areas 8. The seal 10 consists of an elastic material which can be compressed in volume, such as, for example, a foam material.

FIG. 1 shows a screw cap screwed-on to the bottle. As the cap is turned on the threads, contact forces between the sealing surface 7 and lip 9 to seal the bottle mount very rapidly and simultaneously impede applying further torque to screw cap. Thus, the sealing surface 7 is in a precisely defined position in relation to the frontal surface 9 of the neck of the bottle 5 determined by the compressed portion of seal 10 between raised areas 8.

As the cap is screwed on, the seal 10 is also compressed, in the raised area 8 by the same distance, but because the thickness of the seal 10 is greater in those areas, lesser support forces are imposed on the frontal surface 9 of the neck 5 of the bottle 6. This force is inversely proportional to the thickness of the seal. With increasing pressure in the bottle, the material of the seal 10 in the raised areas 8 is compressed to lift the seal from lip 9 to permit excess pressure to escape. The force at which the excess pressure escapes is essentially determined by the thickness of the seal in the raised areas 8 and the compressibility of the seal in these areas.

Figure 4:
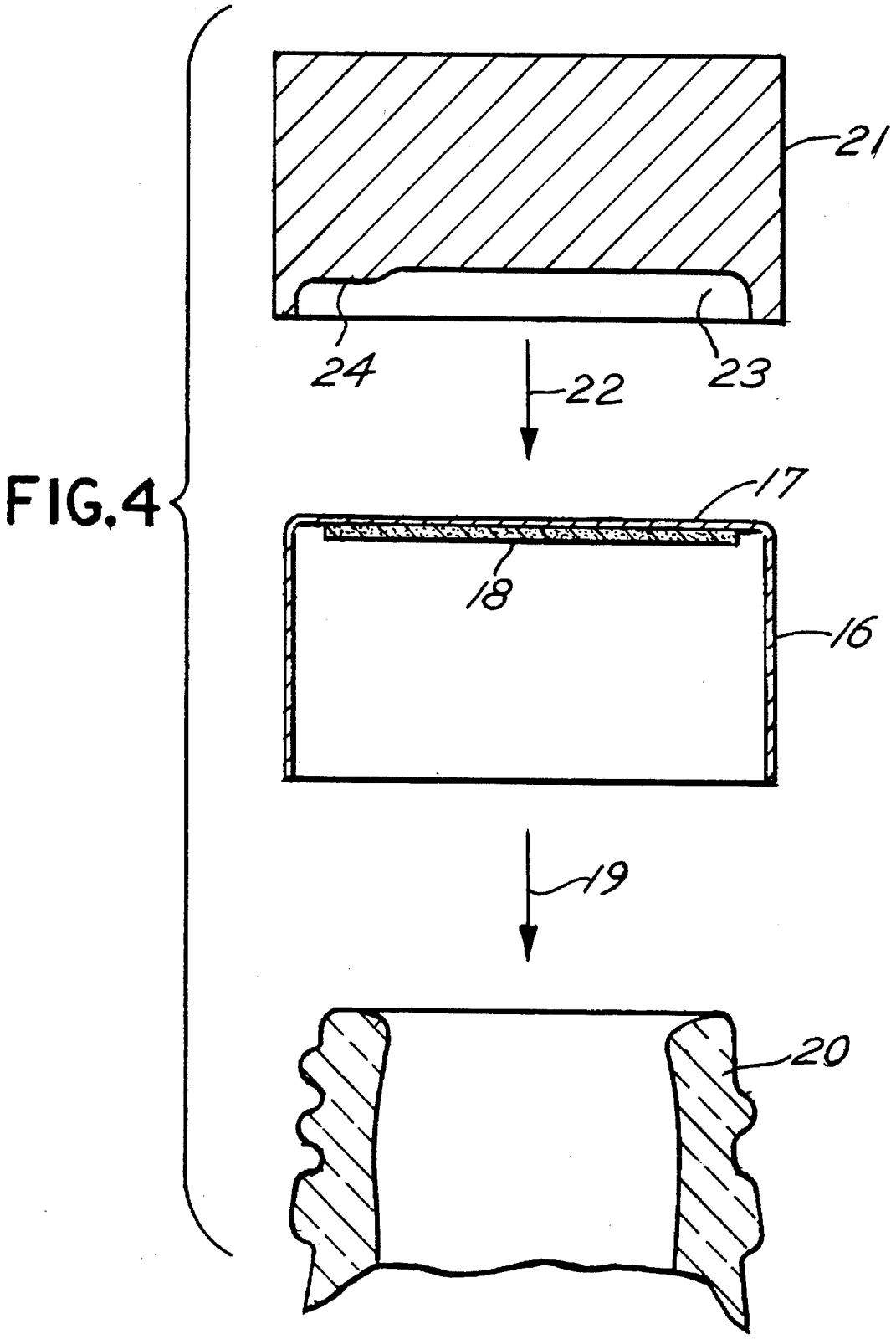
FIG. 4 illustrates the steps of the process in accordance with the invention.
Figure 5:
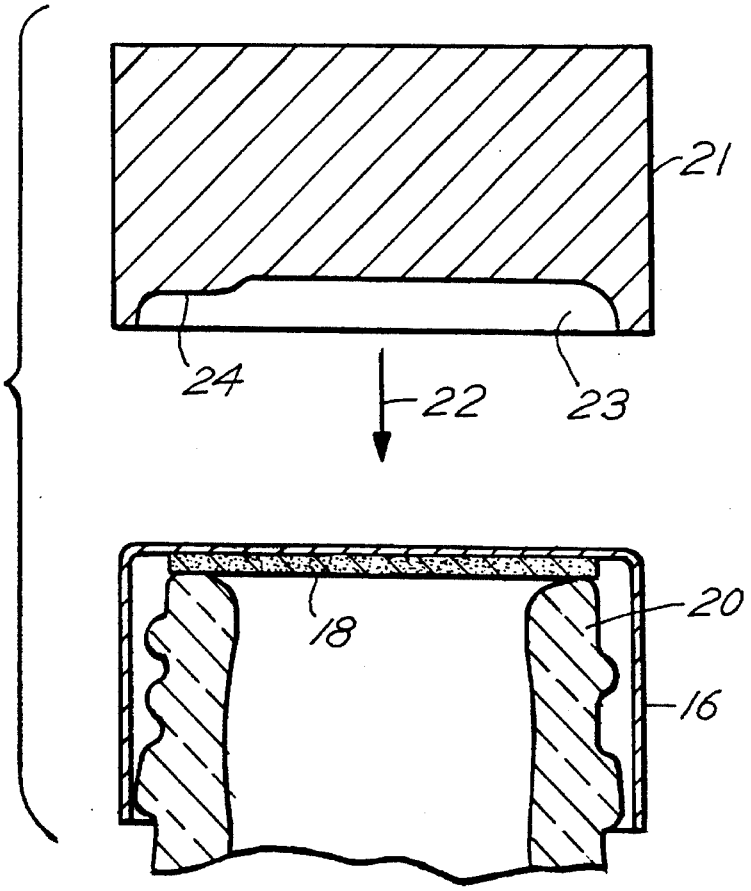
FIG. 5 depicts an intermediary step in the process in accordance with the invention.
Figure 6:
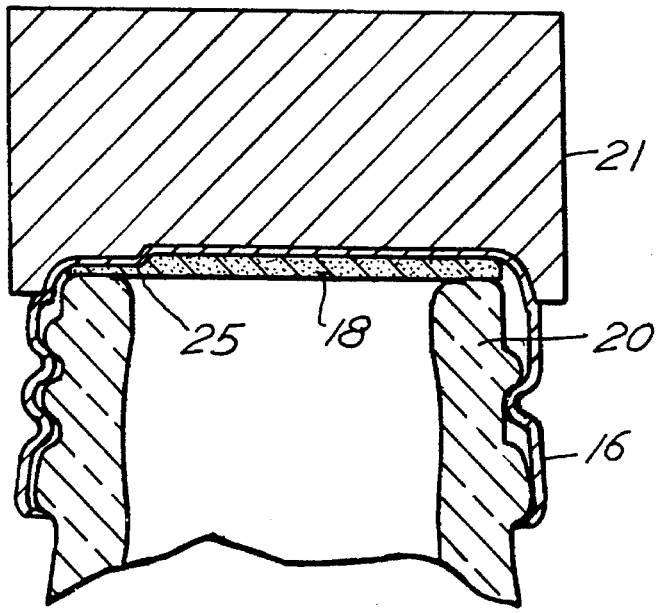
FIG. 6 depicts the end stage of the process.

FIGS. 4 to 6 illustrate different process steps in the implementation of the process in accordance with the invention for the manufacture of a sealing closure in accordance with FIGS. 1–3. First, a sealing disk 18, which is smooth, is inserted into a cap-shaped sealing closure, consisting of a support part 16 and sealing part 17, which is likewise smooth. Everything is then placed together, in the direction of an arrow 19, onto the end of a neck of the bottle 20, as shown in FIG. 5. After that, a compression die 21 is lowered in the direction of an arrow 22 against the sealing part 17. Within the cross section of die 21 shown in FIGS. 4 and 5 there is provided a depression 23, from which a projection 24 protrudes. As the die presses into the sealing part 17, it produces depressions 25, at spaced points, as can be seen from FIG. 6. Since depressions 25 are spaced slightly from bottle lip 9, the sealing disk 18 is greatly compressed in these shaped areas. The depressions 25 practically form a limiting stop which guarantees a precise placement of the sealing closure cap in relation to the frontal edge or lip 9 of the neck of the bottle 20, and also the compression of the sealing disk 18 in the circumference areas 26. This specific compression in the areas 26, which can be reproduced by means of the torque limited by depressions 25, determines a precisely defined pressure at which excess pressure can escape.

In the position depicted in FIG. 6, threads are produced, by means which are not depicted here, by pressing from the outside against the support part 16. The collar serves as an indicator to make the first opening of the bottle visible.

I claim:

1. A process for making a sealing closure for a bottle having a neck with an external flange and terminating in a ring-shaped frontal surface comprising providing a cap which fits over said neck, said cap being made of deformable material, inserting into said cap a disk of compressible elastic material, placing said cap on said bottle neck with said disk bearing against said frontal surface, deforming said cap by means of a forming die by axially pressing it against the cap, which die has, on its forming surface, circumferentially-spaced projections positioned opposite said frontal surface of the neck of the bottle so that the cap is axially pressed at the points of these projections, in the direction toward the frontal surface of the neck of the bottle to produce alternately spaced depressions and projections around the circumference of said cap opposite said frontal surface, whereby said disk is highly compressed in the areas where said cap is depressed, and slightly compressed in the areas of said projections.

2. The process of claim 1 in which the neck is externally threaded, said cap has complementary threads, and said placing step is performed by screwing the cap onto the bottle neck.

* * * * *